US006993804B1

(12) United States Patent
Braun et al.

(10) Patent No.: US 6,993,804 B1
(45) Date of Patent: Feb. 7, 2006

(54) ORAL CARE DEVICES

(75) Inventors: Phillip M. Braun, Exeter, RI (US); William A. Bredall, Pacifica, CA (US); Michael Roberts, Braintree, MA (US); Thomas Craig Masterman, San Francisco, CA (US)

(73) Assignee: The Gillette Company, Boston, MA (US)

( * ) Notice: Subject to any disclaimer, the term of this patent is extended or adjusted under 35 U.S.C. 154(b) by 929 days.

(21) Appl. No.: 09/634,087

(22) Filed: Aug. 8, 2000

(51) Int. Cl.
*A46B 9/04* (2006.01)
*A61H 13/00* (2006.01)

(52) U.S. Cl. ..... 15/110; 15/167.1; 15/188; 601/141; D4/108

(58) Field of Classification Search ..... 15/110, 15/167.1, 188; 601/139, 141; D4/104, 108
See application file for complete search history.

(56) References Cited

U.S. PATENT DOCUMENTS

| | | | | | |
|---|---|---|---|---|---|
| 1,086,936 | A | * | 2/1914 | Pounder et al. | 601/141 |
| 1,693,229 | A | | 11/1928 | Felmar | 15/167.1 |
| 1,758,632 | A | | 5/1930 | Wagner | 15/167.1 |
| 2,246,867 | A | | 6/1941 | Thomas et al. | 15/110 |
| 2,473,773 | A | * | 6/1949 | West | 15/110 |
| 3,230,562 | A | | 1/1966 | Birch | 15/110 |
| 4,403,623 | A | * | 9/1983 | Mark | 15/167.1 |
| 5,735,011 | A | | 4/1998 | Asher | 15/167.1 |

FOREIGN PATENT DOCUMENTS

| | | | | |
|---|---|---|---|---|
| DE | 3621815 | | 1/1988 | |
| EP | 1004282 | | 5/2000 | |
| GB | 2214420 | * | 9/1989 | 15/167.1 |
| IT | 59230 | | 4/1959 | |
| WO | 99/37180 | | 7/1999 | |

* cited by examiner

*Primary Examiner*—Mark Spisich
(74) *Attorney, Agent, or Firm*—Fish & Richardson P.C.

(57) ABSTRACT

Oral devices are provided, including oral brushes that include bristle tufts and a rocking member having radially extending protrusions constructed to penetrate between a user's teeth. The protrusions are shaped to penetrate the interproximal region, cleaning between a user's teeth and stimulating the gums.

1 Claim, 14 Drawing Sheets

ORAL CARE DEVICES

TECHNICAL FIELD

This invention relates to oral care devices, and more particularly to oral brushes. Related subject matter is disclosed in commonly assigned application Ser. No. 09/199,122, abandoned and Ser. No. 09/421,747, U.S. Pat. No. 6,389,634 filed on Nov. 24, 1998 and Oct. 20, 1999, respectively. Further related subject matter is disclosed in commonly assigned U.S. patent application Ser. No. 09/573,576 (now U.S. Pat. No. 6,826,797) entitled "Oral Devices" filed May 18, 2000.

BACKGROUND

Conventional toothbrushes, having tufts of bristles mounted on a head, are generally effective at removing plaque from the flat surface of teeth and the areas between teeth and along the gumline that can be accessed by the bristles. However, such toothbrushes typically cannot clean interproximal and sub-gingival areas where tufts of bristles are unable to penetrate or reach. (The term "interproximal" refers to the areas between the teeth of a mammal.) This is because the bristles tend to pass or flick over the gaps between the teeth and are usually physically impeded from reaching behind the interdental papillae and below the gumline. To clean these areas (col and sub-gingival areas), it is generally necessary to floss between the teeth with dental floss.

While flossing effectively cleans the supra-gingival and sub-gingival regions between teeth, most people do not floss regularly. Failing to floss regularly may result in gingivitis, which can lead to more serious gum diseases. These problems can occur despite regular toothbrushing.

SUMMARY

The invention features oral devices, such as oral brushes, that are capable of providing interproximal and sub-gingival cleaning and/or gingival stimulation. It is believed that these oral brushes provide clinical benefits, e.g., reduction of gingivitis, to users who do not floss regularly but who do use the oral brush regularly, relative to the benefits provided by using a conventional toothbrush with the same regularity without flossing.

In one aspect, the invention features an oral device that includes a body having a head that is shaped for insertion into the oral cavity, and one or more rocking elements, mounted on the head, each rocking element including a central portion and a plurality of protrusions extending radially from the central portion. The rocking or pivoting motion of the rocking element(s) typically allows interproximal penetration and/or gum stimulation to be achieved using the user's normal brushing motion.

Preferred embodiments may include one or more of the following features. The rocking element is mounted in a slot in the head of the oral device. The slot is shaped and sized to allow rocking of the rocking element in one direction, while restricting the rocking element from moving in a perpendicular direction. The protrusions of the rocking element taper from a relatively wide base to a relatively narrow tip. The tips are shaped to penetrate the interproximal and subgingival regions of the oral cavity. The tips are preferably less than 0.070 inches wide, more preferably from about 0.005 to 0.025 inches. The rocking element has a thickness of less than 0.200 inches, more preferably 0.050 to 0.125 inches, and most preferably 0.080 to 0.100 inches. The rocking element has an overall diameter less than 1.000 inches, more preferably 0.500 to 0.700 inches, and most preferably 0.550 to 0.650 inches. The rocking element is formed of a material having a durometer reading of from about 20 to 90 Shore A, more preferably 40 to 80 Shore A. The central portion of the rocking element includes an opening therethrough, sized to allow the rocking element to collapse and conform to a user's tooth shape during use. The rocking element is co-molded with the head of the oral care device, or, alternatively, the rocking element includes a mounting element sized to mount into a hole in the head of the oral care device. The mounting element acts as a fulcrum for the rocking movement of the rocking element. The central portion of the rocking element is spherical. The protrusions are located on the upper hemisphere of the spherical central portion. The protrusions are spaced less than 90 degrees apart, more preferably 65 to 80 degrees apart. The protrusions are generally cylindrical. The protrusions have a base diameter of 0.100 inches, more preferably 0.010 to 0.100 inches, and most preferably 0.040 to 0.060 inches. The protrusions have a length less than 0.100 inches, more preferably 0.050 to 0.175 inches, and most preferably 0.070 to 0.080 inches. The spherical central portion has a diameter less than 0.300 inches, more preferably 0.100 to 0.0300 inches, most preferably 0.200 to 0.250 inches.

In another aspect, the invention includes an oral brush that includes a body having a head shaped for insertion into the oral cavity, tooth cleansing elements extending from a top surface of the head, and one or more rocking elements mounted on the head, each rocking element including a central portion and a plurality of protrusions extending radially from the central portion, the protrusions tapering from a relatively wide base to a relatively narrow tip, the tips being sized and shaped to penetrate the interproximal and subgingival regions.

The invention also features methods of using the above-described oral brushes. In one method, the oral device is inserted into the oral cavity and the user brushes the teeth with the oral brush. Preferably, the teeth are brushed with a motion that causes the protrusions to penetrate into the interproximal region and stimulate the gums.

Other features and advantages of the invention will be apparent from the description and drawings, and from the claims.

DESCRIPTION OF DRAWINGS

FIG. 6B is a perspective view of an alternative embodiment of the rocking element shown in FIG. 6.

DETAILED DESCRIPTION

Figure 1:
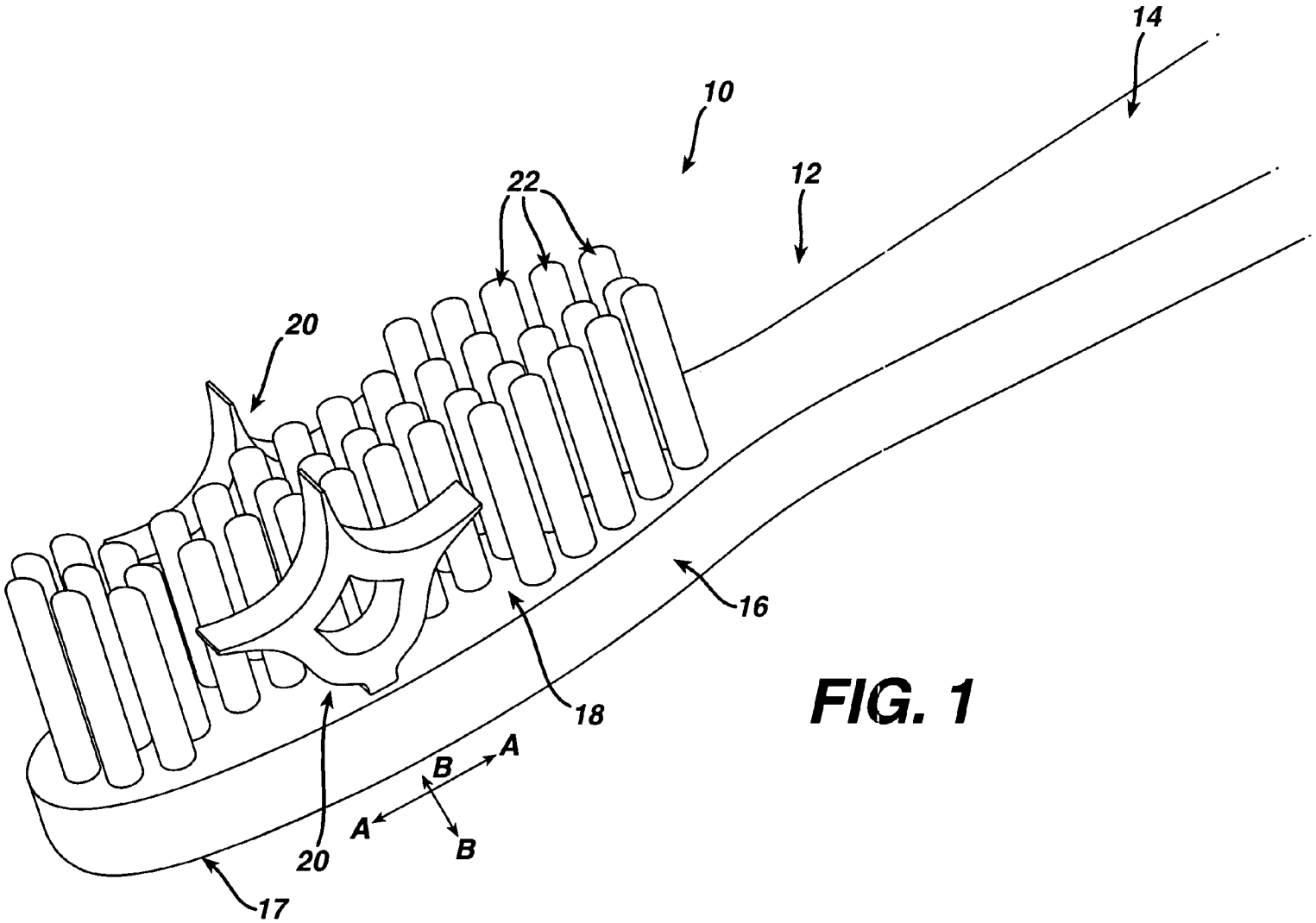
FIG. 1 is a perspective view of an oral brush according to one embodiment of the invention.
Figure 2:
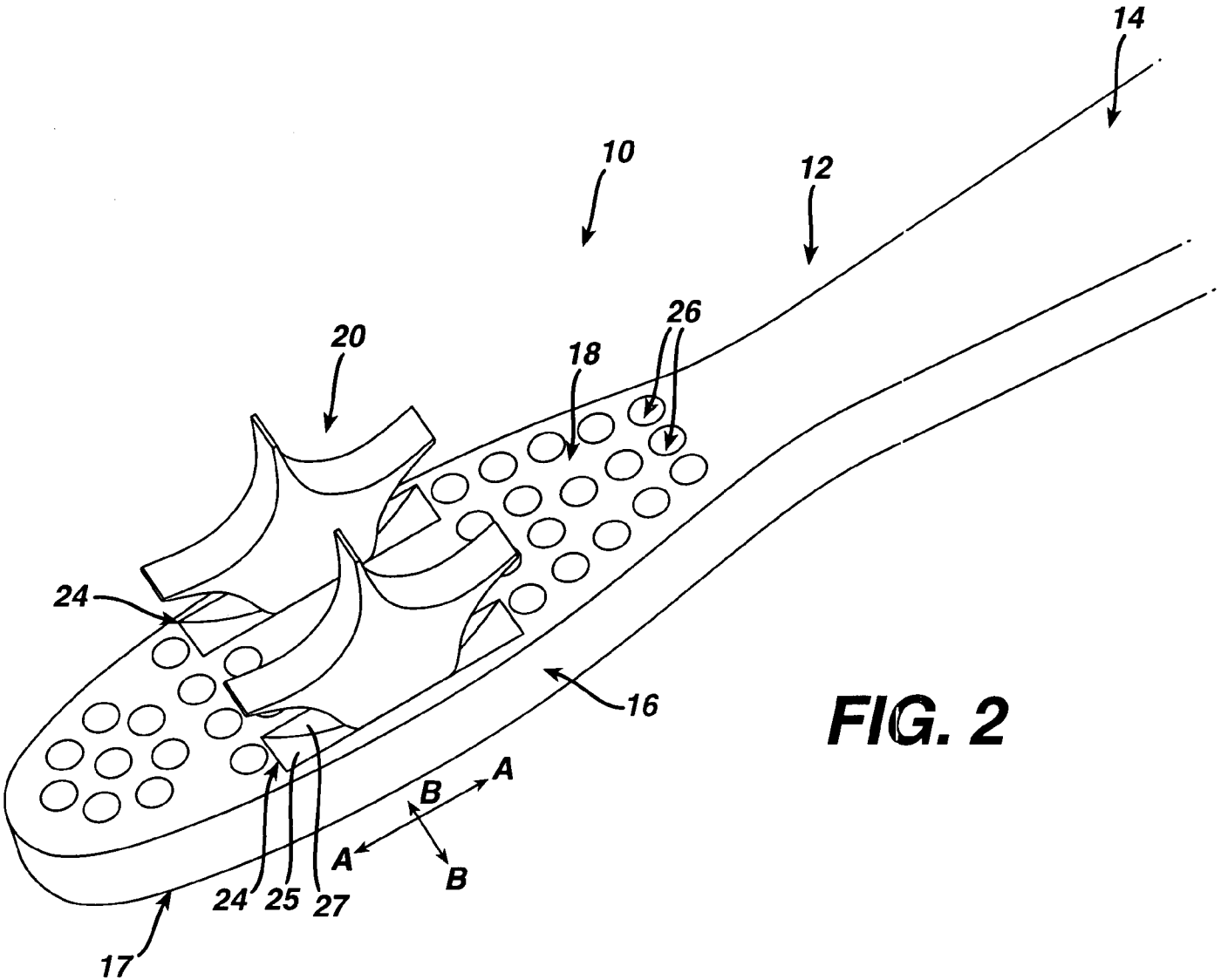
FIG. 2 is a perspective view of an oral brush according to an alternate embodiment of the invention. The bristles are omitted for clarity.

Referring to FIGS. 1 and 2, an oral brush 10 includes a body 12 that defines a handle 14 and a head 16. Head 16 includes a top surface 18 having a plurality of apertures 26 (FIG. 2) that are constructed to receive tooth cleansing elements, such as tufts of bristles 22 (FIG. 1) and a bottom surface 17. A pair of rocking elements 20 are mounted on the head 16 on the top surface 18, towards the outer edges of the head 16. Each rocking element 20 is constructed to rock back and forth during brushing, generally in the direction indicated by arrows AA, to penetrate the interproximal region and stimulate the gums, as will be discussed further below.

The rocking elements 20 can be mounted flush with the top surface 18 (FIG. 1), or in wells 24 formed in the head 16 (FIG. 2). Each well 24 is generally shaped to provide lateral support to the rocking element 20 so as to facilitate the rocking motion in the direction of arrows AA and prevent excessive lateral movement, i.e., movement in the direction of arrows BB (FIG. 2). Thus, the sidewalls 27 of the well 24 will restrict movement of the rocking element 20 in a direction perpendicular to the direction of the rocking motion. The width of the well 24 will depend on the thickness of the rocking element 20. The clearance between sidewalls 27 and the face surfaces 33 of the rocking element should be sufficient to allow the rocking element 20 to rock freely, while constraining the rocking element 20 in a direction perpendicular to the rocking plane. Generally, the clearance is from about 0.010 to 0.050 inches.

Figure 3:
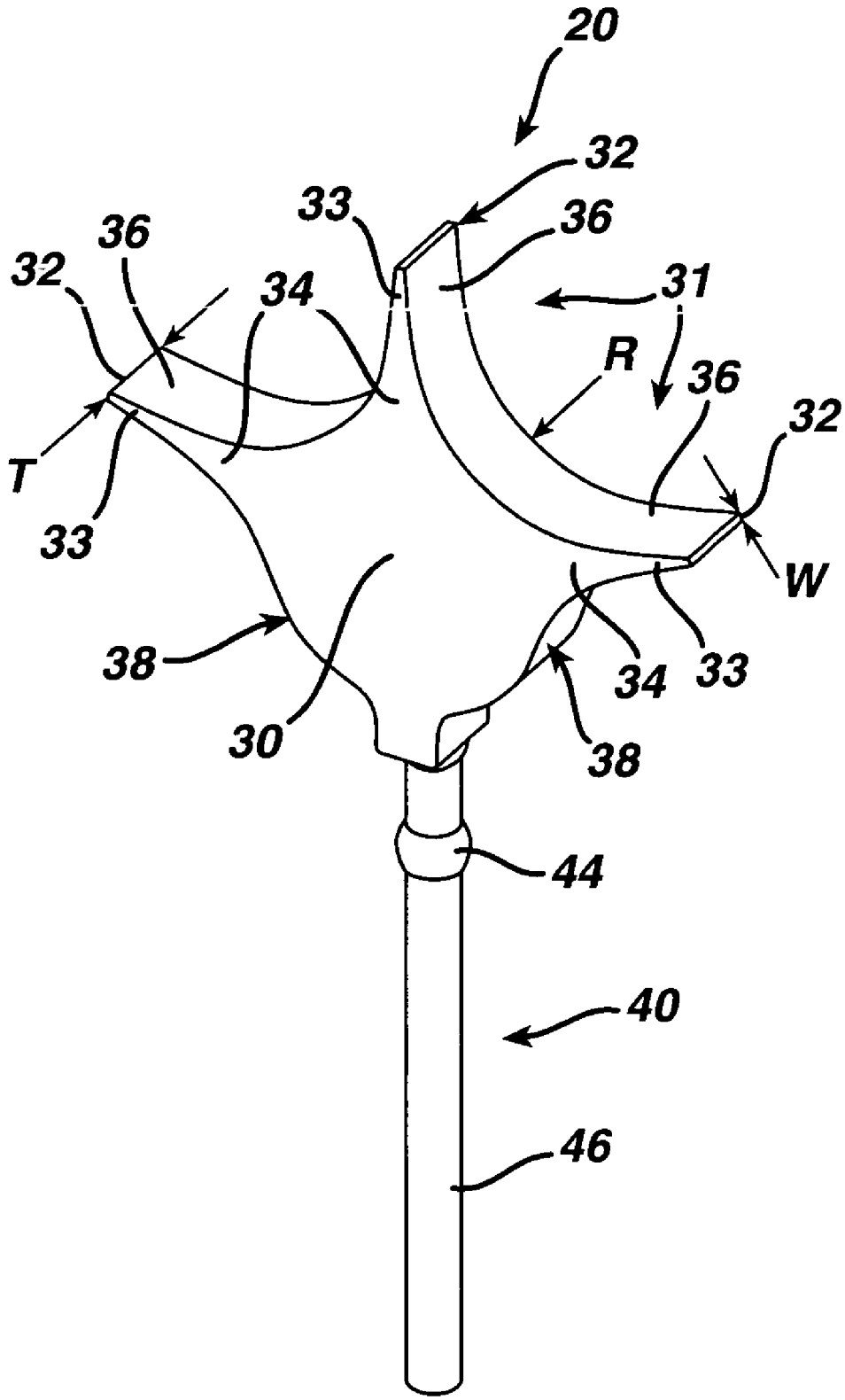
FIGS. 3–6B are perspective views of rocking elements according to alternate embodiments of the invention.
Figure 3B:
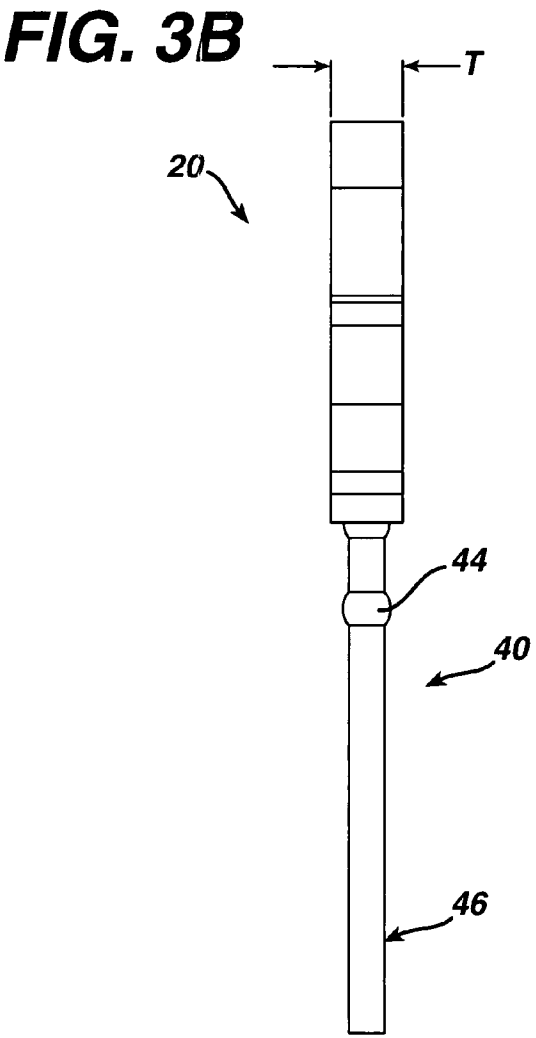
FIGS. 3A and 3B are front and side views of a rocking element according to an embodiment of the invention.
Figure 3A:
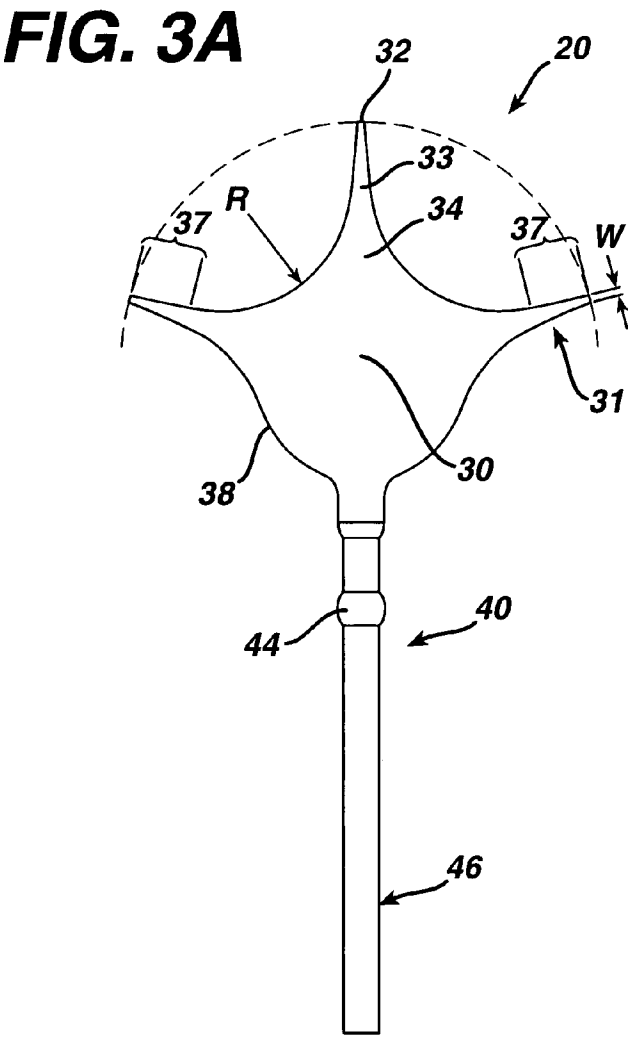

Referring to FIGS. 3, 3A and 3B, rocking element 20 includes a central region 30, and, extending radially from the central region 30, a plurality of protrusions 31. The protrusions 31 taper from a relatively wide base 34 to a narrow tip 32. The protrusions 31 may also be substantially straight throughout (not shown). Because the tips 32 are relatively thin, as the rocking element 20 passes over the teeth, the tips 32 will penetrate into the interproximal regions. Side surfaces 36 will rub against and clean the teeth in the interproximal region, and face surface 33 will tend to contact the gums, resulting in massaging and cleaning of the supragingival area.

Central region 30 is generally circular with the three protrusions 31 being spaced about the upper half of the central region 30 to generally correspond to the spacing of human teeth. The protrusions 31 are substantially equal in their dimensions, and the tips 32 generally define a circle. The diameter of the circle is preferably less than 1.000 inches, more preferably from about 0.500 to 0.700 inches, and most preferably from about 0.550 to 0.650 inches. The side surfaces 36 each define an arc having a radius of curvature R of from about 0.150 to 0.175. The effective tip length that will penetrate between two adjacent teeth is from about 0.025 to 0.150 inches. The tips 32 taper to a width W of less than 0.070, more preferably from about 0.005 to 0.025 inches. It is noted that each tip 32 is tapered to a thickness that is less than the thickness that would be dictated by the radius of curvature R. That is, following the curve dictated by R would result in the protrusion 31 becoming undesirably wider towards the tip 32. Therefore, a portion of side surface 36 tapers linearly to the tip 32, shown in FIG. 3A at 37. The rocking element 20 has a thickness T (FIG. 3B) of less than 0.200 inches, more preferably from about 0.050 to 0.125 inches, and most preferably from about 0.080 to 0.100 inches.

During brushing, the rocking element 20 will rock back and forth, with mounting shaft 40 as its fulcrum (described in detail below), until it contacts camming surface 38. Camming surface 38 will contact either the top surface 18, if no well 24 is used, or the well bottom 25, when a well 24 is used. The camming surface 38 is shaped to allow the desired rocking distance. Varying the shape of the camming surface or adding detents to the camming surface can control the amount of rocking. The shape of the well bottom 25 can also control the amount of rocking, when a well 24 is used.

Figure 4:
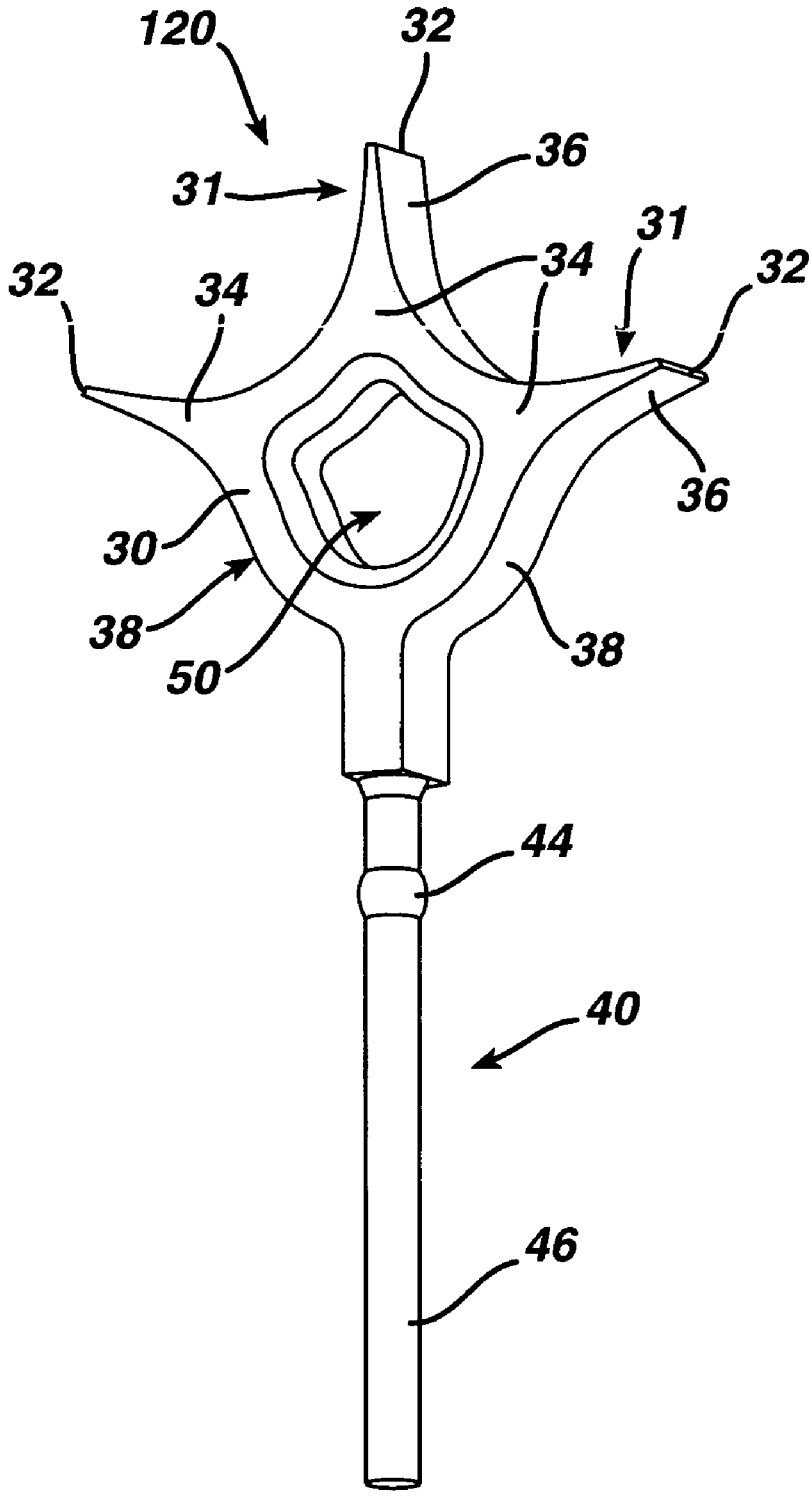
Figure 4A:
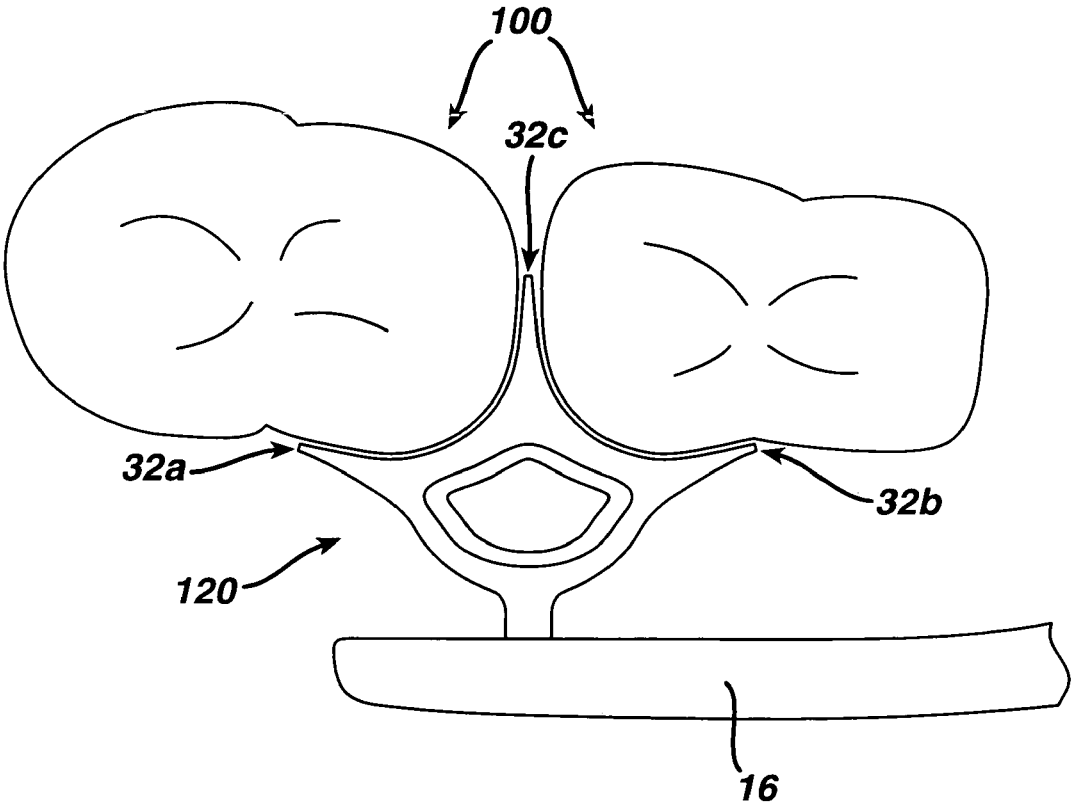
FIG. 4A is a schematic view of a rocking element in use according to an embodiment of the invention.

FIG. 4 shows an alternate rocking element 120. The rocking element 120 includes an opening 50 extending through the thickness of the rocking element 120 in the central region 30. The opening 50 is sized and shaped to allow the rocking element 120 to collapse (due to the resilient nature of the elastomeric material used to form the rocking element 120) and thereby conform to a user's teeth 100. As shown in FIG. 4A, the rocking element 120 will collapse under normal brushing pressure, causing the tips 32*a*, 32*b* to be urged towards the tip 32*c* that is within the interproximal region. Side surfaces 36 then wrap around the teeth 100, and a portion of the side surfaces 36 penetrate into the interproximal region (FIG. 4A). This wrapping action will help clean between the teeth 100 and polish the outer surface of the teeth 100. The opening 50 is generally sized to allow the rocking element 120 to collapse under normal pressure, while maintaining lateral stiffness.

Figure 5:
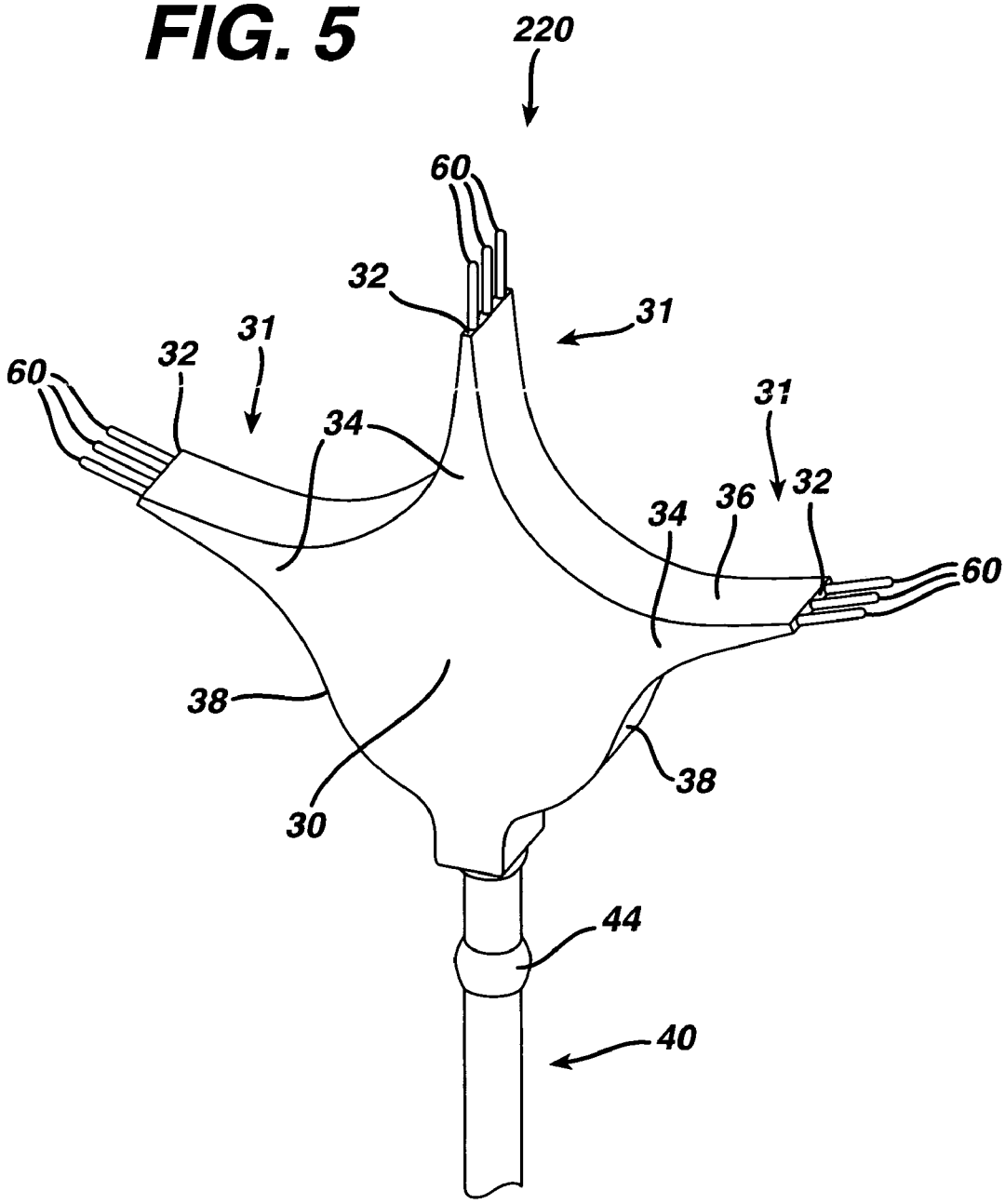

FIG. 5 shows another alternate rocking element 220. Bristles 60 extend from the tips 32 to facilitate better penetration into the interproximal region. The added length provided by the bristles will cause deeper penetration into the interproximal region, allowing more thorough cleaning. The bristles may be co-molded with the rocking element, or joined to the rocking element in any suitable manner. Further, the bristles 60 may be standard toothbrush bristles, plastic elements or rubber elements. The length of the bristles 60 is preferably less than 0.150, more preferably from about 0.025 to 0.150, most preferably from about 0.025 to 0.075 inches. The diameter of the bristles 60 is preferably less than 0.012, more preferably from about 0.002 to 0.010 inches. The spacing between the bristles 60 is from about 0.010 to 0.100 inches.

Figure 5A:
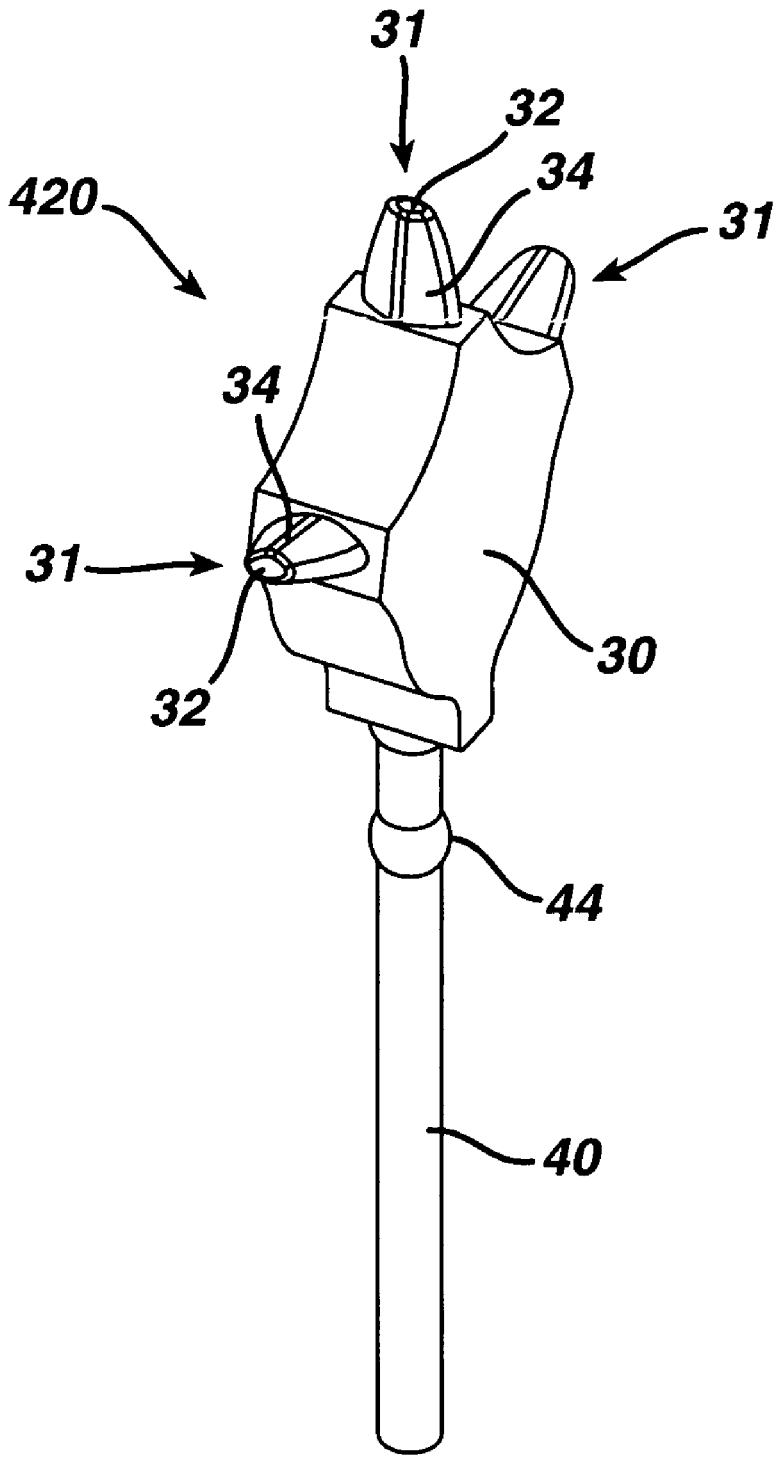
FIGS. 5A and 5B are schematic perspective views of rocking elements according to alternate embodiments of the invention.

FIG. 5A shows another alternative rocking element 420. The protrusions 31 are diamond shaped in cross section. The protrusions 31 taper in two dimensions from a relatively wide base 34 to a relatively narrow tip 32. This "double taper" provides a protrusion with angled surfaces capable of wedging between a user's teeth. The geometry and benefits of such a shape for the protrusions 31 is described in U.S. patent application Ser. No. 09/573,576, (now U.S. Pat. No. 6,826,797) entitled "Oral Devices," filed on May 18, 2000, assigned to The Gillette Company, assignee of the present invention, and incorporated herein by reference.

Figure 5B:
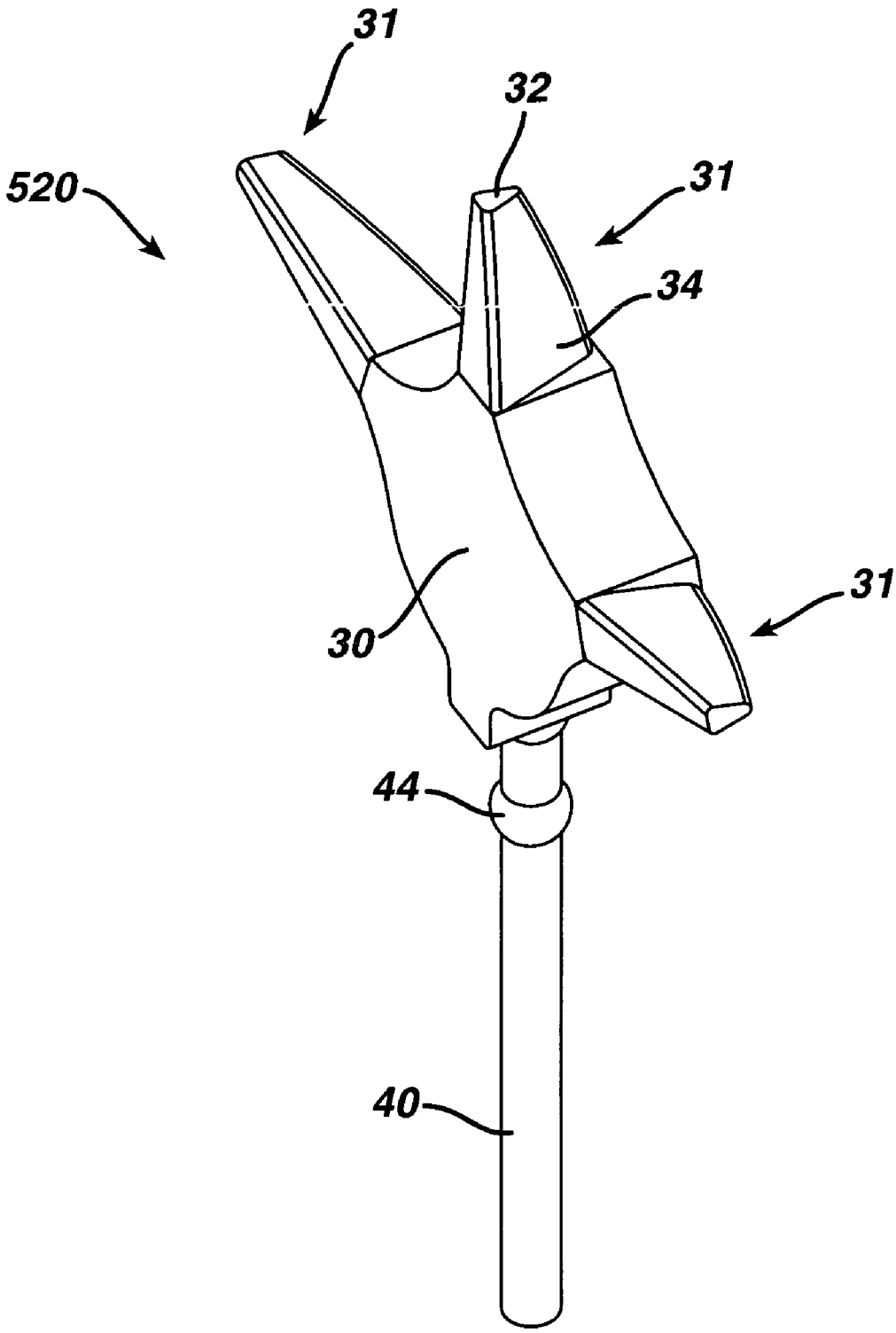

FIG. 5B shows another alternative rocking element 520. The protrusions 31 are triangular shaped in cross section. The protrusions 31 taper in two dimensions from a relatively wide base 34 to a relatively narrow tip 32. This "double taper," as described above, is capable of wedging between a user's teeth. The geometry and benefits of such a shape for the protrusions 31 is described in U.S. patent application Ser. No. 09/573,576, incorporated by reference above.

Figure 6:
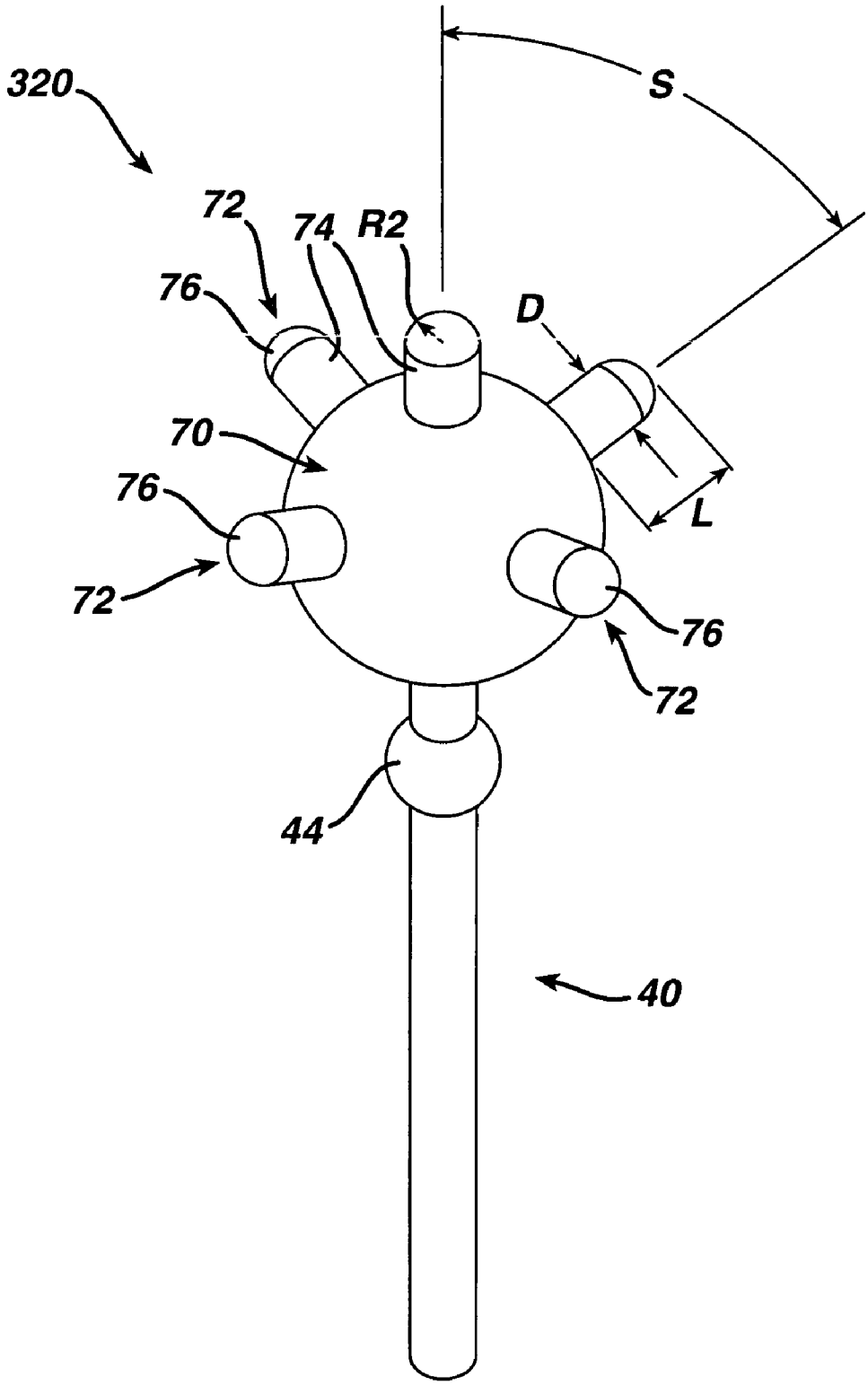
Figure 6A:
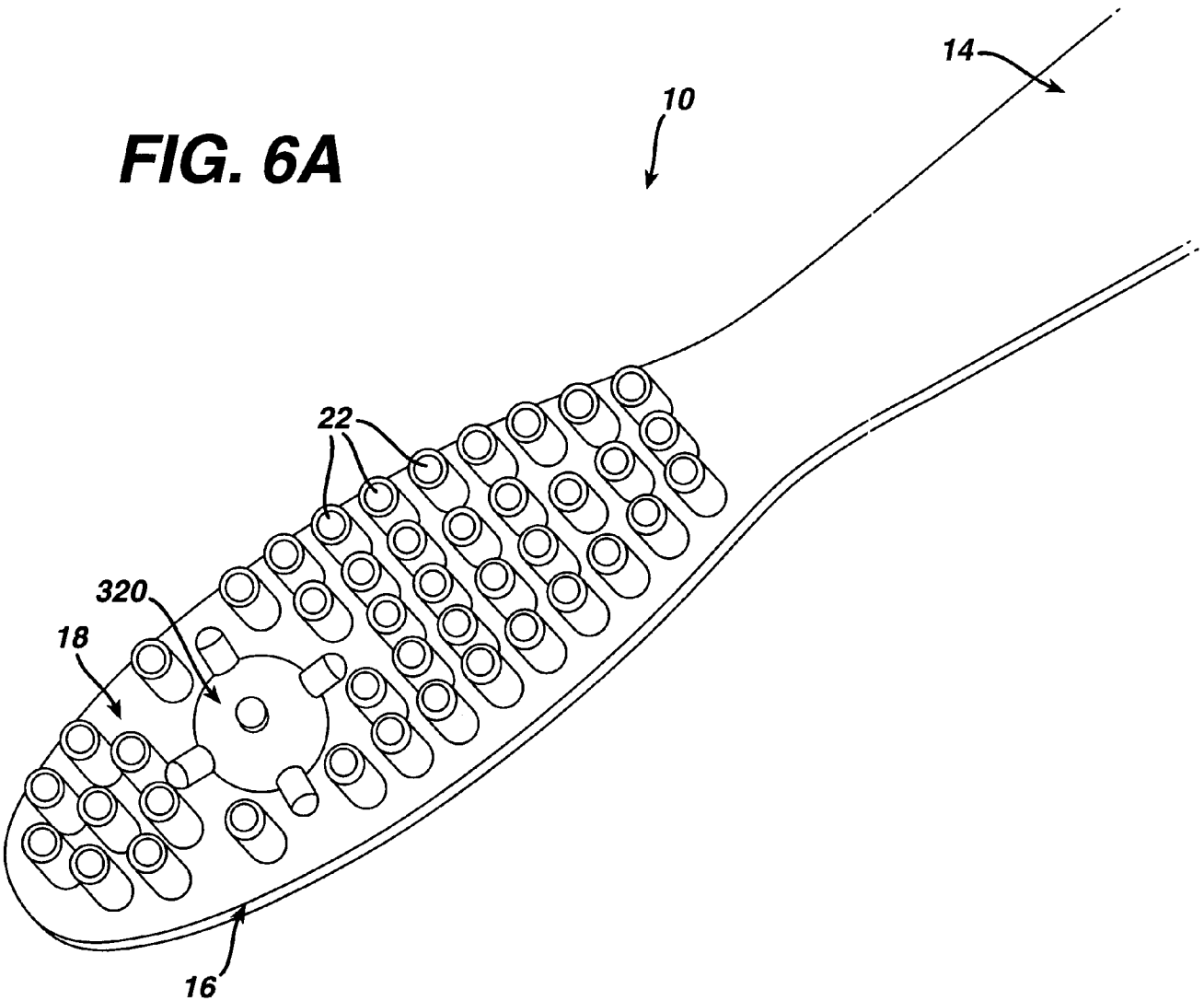
FIG. 6A is a perspective view of an oral brush according to an alternate embodiment of the invention.
Figure 6B:
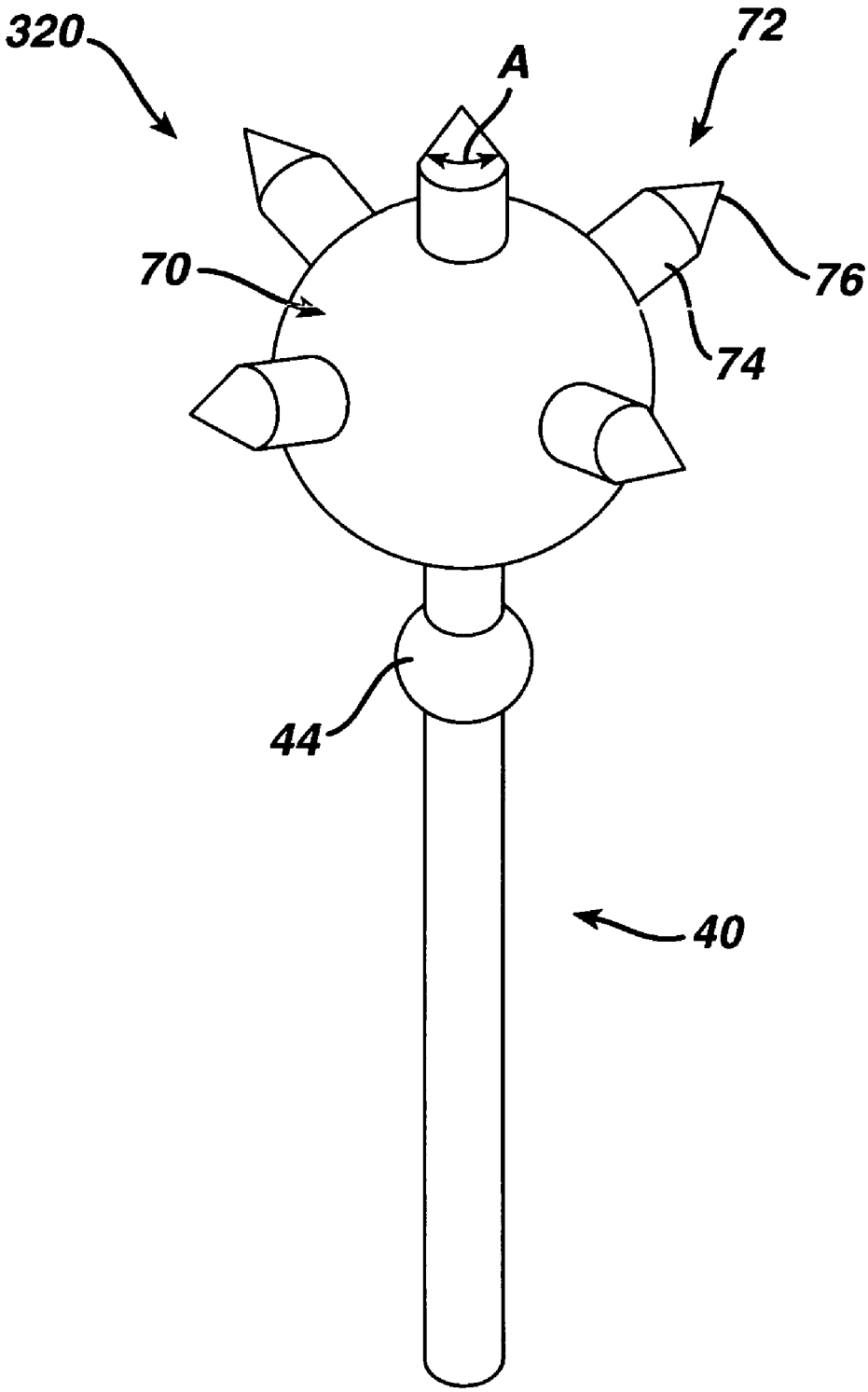

FIG. 6 shows another alternate rocking element 320. The rocking element 320 is more omnidirectional than the rocking elements described above, resulting in easier use during circular brushing. The rocking element 320 includes a spherical body 70 and, extending radially from the upper hemisphere of the spherical body 70, a plurality of protrusions 72. The protrusions 72 taper from a generally cylindrical base 74 to a hemispherical tip 76. The protrusions 72 are shaped and sized to penetrate into the interproximal region. The rocking element 320 rocks on the lower hemisphere of the spherical body 70, pivoting around mounting shaft 40 (described in detail below). The hemispherical shape allows for a rocking movement in all directions. Therefore, a well 24 would generally not be used with this embodiment. The diameter of the spherical body 70 is preferably less than 0.300 inches, more preferably from about 0.100 to 0.300 inches, and most preferably from about 0.200 to 0.250 inches. The protrusions 72 have a length L that is preferably less than 0.200 inches, more preferably from about 0.050 inches to 0.175 inches, and most preferably from about 0.070 to 0.080 inches. The cylindrical base 74 of the protrusions 72 have a diameter D that is preferably less than 0.100 inches, more preferably from about 0.010 inches to 0.100 inches, and most preferably from about 0.040 to 0.060 inches. The tips 76 of the protrusions 72 may be hemispherical (FIG. 6) or conical (FIG. 6B). The radius of curvature R2 for the hemispherical tip 76 is preferably 0.050 inches, more preferably from about 0.010 to 0.040 inches, and most preferably from about 0.010 to 0.025 inches. The taper angle A for the conical tip 76 (FIG. 6B) is preferably 75 degrees, more preferably from about 30 degrees to 60 degrees, and most preferably from about 40 to 50 degrees. The protrusions 72 are spaced about the spherical body 70 at regularly spaced angles S. The angle S is preferable less than 90 degrees, most preferably from about 65 degrees to 80 degrees.

Figure 7:
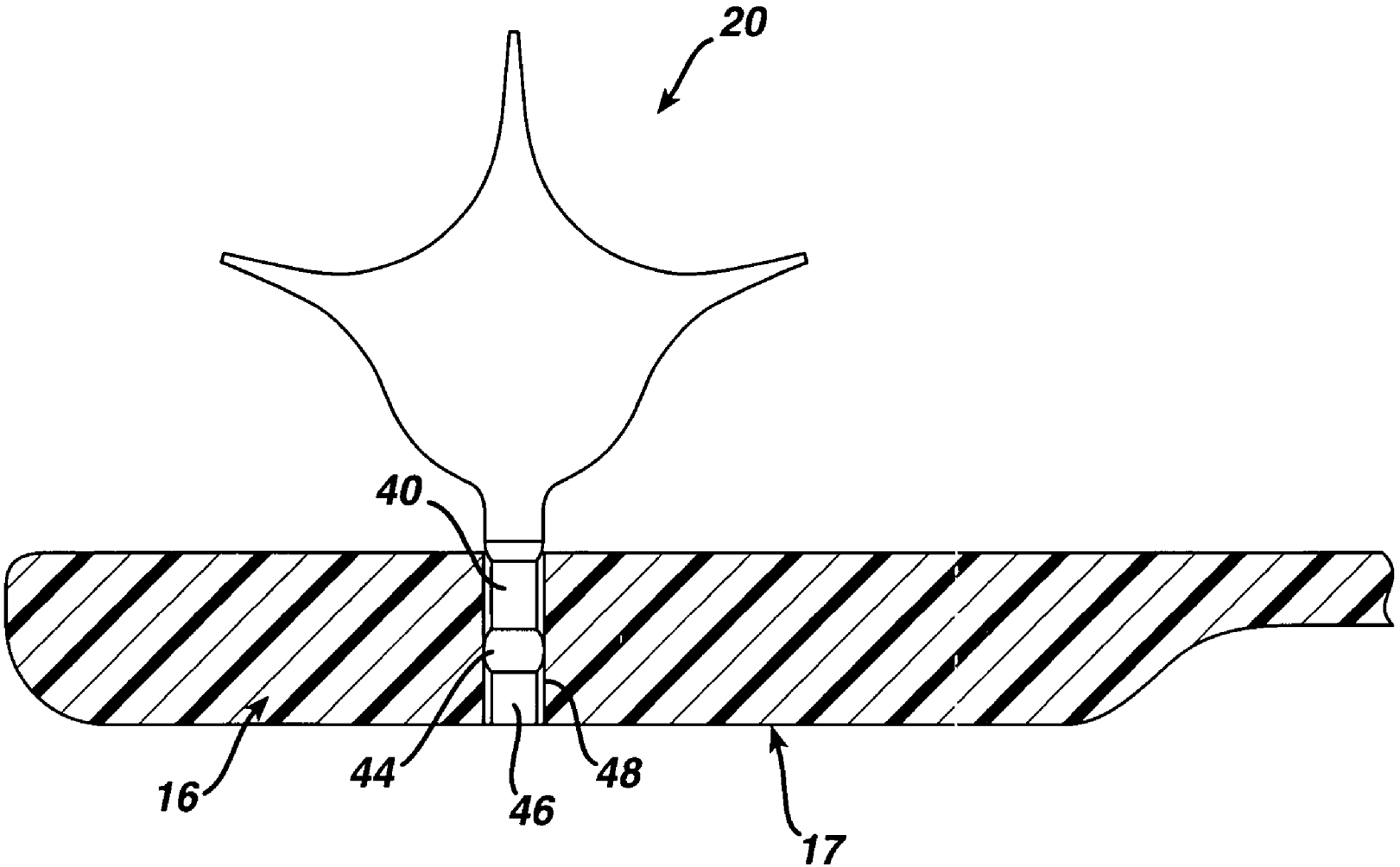
FIGS. 7 and 7A are a cross-sectional views of an oral brush according to one embodiment of the invention.
Figure 7A:
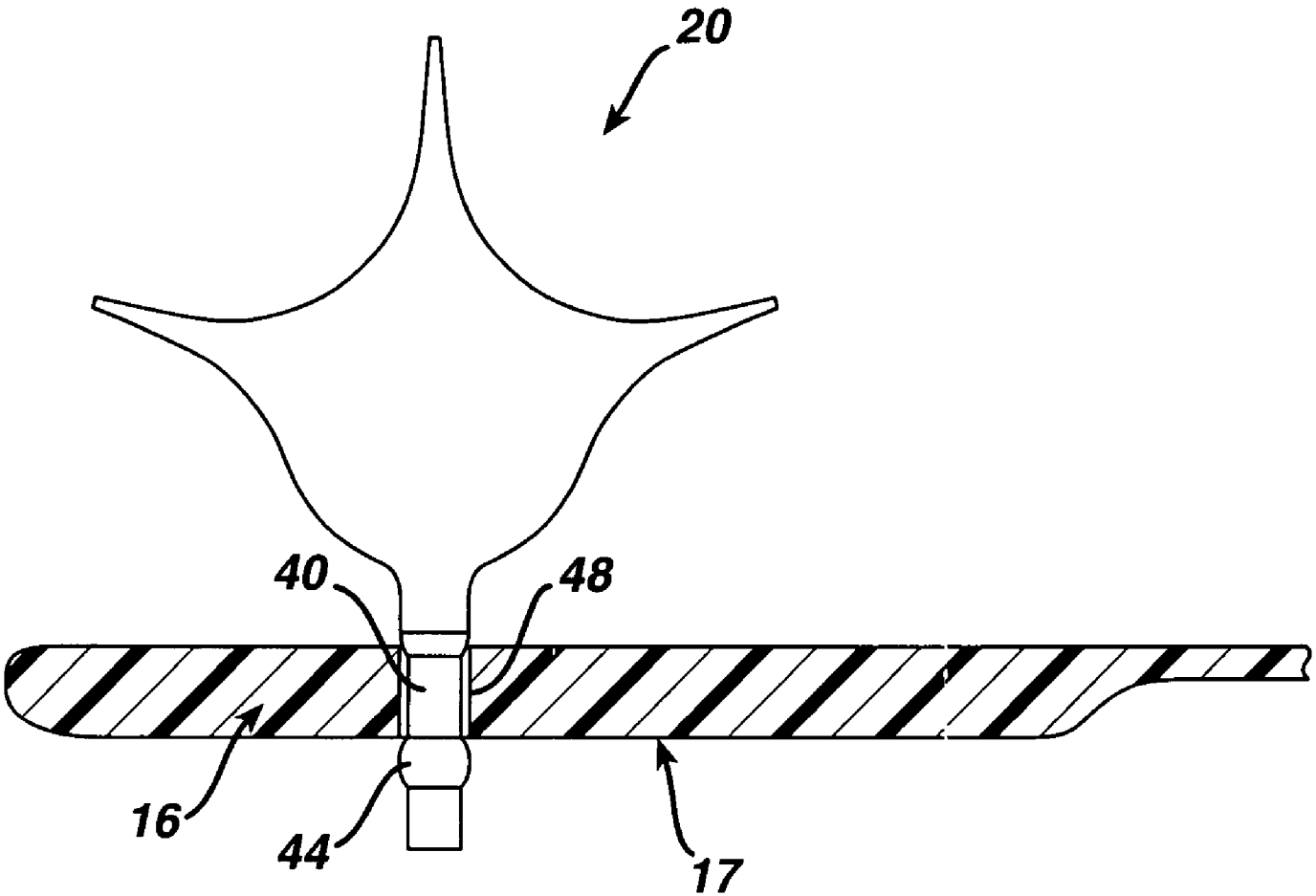

The preferred rocking elements shown in FIGS. 3–6 also include a mounting shaft 40 that includes a resilient protrusion 44. One suitable technique for mounting the rocking element 20 on the oral brush 10 is by an interference fit between protrusion 44 and the bottom surface 17 of head 16, as shown in FIG. 7A. As shown in FIG. 7, the mounting shaft 40 is pulled through a bore 48 in the head 16 having a diameter smaller than the protrusion 44, temporarily compressing the protrusion 44. Protrusion 44 is held in place by an interference fit when the protrusion 44 expands to its normal size upon exiting the bore (FIG. 7A). The portion 46 of mounting shaft that extends beyond the protrusion is trimmed flush with the head 16. Alternatively, the protrusion 44 could be set into a countersink (not shown) in the head 16.

In the mounting arrangement shown in FIG. 7A, the mounting shaft 40 is the fulcrum of the rocking element 20. The diameter of mounting shaft 40 is generally from about 0.060 to 0.070 inches. The diameter of protrusion 44 is generally from about 0.080 to 0.090 inches. In production, the rocking element 20 may be mounted by insert molding the rocking element 20 into the head 16 of the oral device 10. Insert molding would eliminate the need for a through bore 48 in the head 16. Instead, the mounting shaft 40 would be embedded in the head 16 during the molding of the body 12.

The rocking element 20 can be mounted in the center of the head 16 if a single rocking element 20 is used. In embodiments with more than one element, the rocking elements 20 may be mounted towards the sides of the head 16. Alternatively, the rocking elements 20 may be mounted towards the midpoint of the head 16 or towards the front of the head 16.

Suitable materials for the rocking element 20 include those that are safe for use in the oral cavity and which have suitable mechanical properties. The material used to form rocking element 20 is preferably relatively soft and flexible, to avoid user discomfort and to allow the tips 32 to flex during brushing to better penetrate the interproximal region. The material should also be strong and flexible to allow the mounting shaft 40 to flex and allow the rocking member 20 to rock. Preferably, the material has a durometer reading of from about 20 to 90 Shore A, most preferably about 40 to 80 Shore A. To obtain these properties, the rocking elements 20 are preferably formed of a thermoplastic elastomer. Suitable thermoplastic elastomers include, e.g., KRATON-type rubber-based block copolymers such as DYNAFLEX G2701 and DYNAFLEX G2755 polymers, commercially available from GLS Corporation, Cary, Ill. The tips 32 can be co-molded with the rest of the rocking element 20, allowing the rest of the rocking element 20 to be formed of a different material. In this case, the tips 32 can be formed of a relatively softer material. Suitable tip materials include KRATON-type rubber-based block copolymers having a hardness of about 50–90 Shore A, e.g., DYNAFLEX G2780 polymer.

Texture can be added to the rocking elements 20 to facilitate better cleaning, such as scraping plaque off the teeth. The texture can be added by molding texture directly into the entire rocking element 20 or the protrusions 31 and 72. Texture can also be achieved by the addition of an abrasive to the base material used to make the rocking elements 20.

Other embodiments are within the claims. For example, one or more rocking elements may be used on an oral care device without cleansing elements. Such a device can be used to clean and massage the gums and interproximal region, with a conventional toothbrush being used separately to clean the teeth. Rocking elements may also be mounted on the body 10 at the end of handle 14 that is opposite the head 16. Further, the oral brush 10 could include only one rocking element, or more than two rocking elements 20.

What is claimed is:

1. An oral care device comprising a body defining a longitudinal axis having a head shaped for insertion into the oral cavity, and a rocking element mounted on the head, the rocking element including a central portion and a plurality of protrusions extending radially from the central portion along the longitudinal axis of the body, wherein the protrusions taper from a relatively wide base to a relatively narrow tip and wherein the tips are shaped to penetrate the interproximal and subgingival regions of the oral cavity, wherein the central portion further includes an opening therethrough sized to allow the rocking element to conform to a tooth's shape during use.

* * * * *

UNITED STATES PATENT AND TRADEMARK OFFICE

CERTIFICATE OF CORRECTION

PATENT NO. : 6,993,804 B1
APPLICATION NO. : 09/634087
DATED : February 7, 2006
INVENTOR(S) : Phillip M. Braun et al.

It is certified that error appears in the above-identified patent and that said Letters Patent is hereby corrected as shown below:

On the Title page, item (75), "Michael Roberts, Braintree, MA (US)" should be --Michael Roberts, Brookfield, CT (US)--.

Signed and Sealed this

Twenty-first Day of November, 2006

JON W. DUDAS
*Director of the United States Patent and Trademark Office*